US006441549B1

(12) United States Patent
Trentelman

(10) Patent No.: US 6,441,549 B1
(45) Date of Patent: Aug. 27, 2002

(54) GLASS ENVELOPE HAVING CONTINUOUS INTERNAL CHANNEL WITH CONNECTED SECTIONS OF DIFFERENT DIMENSIONS

(75) Inventor: Jackson P. Trentelman, Painted Post, NY (US)

(73) Assignee: Corning Incorporated, Corning, NY (US)

( * ) Notice: Subject to any disclaimer, the term of this patent is extended or adjusted under 35 U.S.C. 154(b) by 0 days.

(21) Appl. No.: 09/402,243

(22) PCT Filed: Apr. 1, 1998

(86) PCT No.: PCT/US98/06501

§ 371 (c)(1),
(2), (4) Date: Sep. 29, 1999

(87) PCT Pub. No.: WO98/44528

PCT Pub. Date: Oct. 8, 1998

Related U.S. Application Data

(60) Provisional application No. 60/042,568, filed on Apr. 1, 1997.

(51) Int. Cl.[7] ..... H01J 1/62; H01J 63/04; H01J 17/16; H01J 61/30

(52) U.S. Cl. ..... 313/493; 313/634; 428/426

(58) Field of Search ..... 313/493, 634, 313/513, 636; 501/900; 428/46, 426

(56) References Cited

U.S. PATENT DOCUMENTS

| | | | | |
|---|---|---|---|---|
| 1,923,148 A | * | 8/1933 | Hotchner | 313/634 |
| 2,621,430 A | * | 12/1952 | Neville | 313/634 |
| 2,987,640 A | | 6/1961 | Paolino | |
| 3,047,763 A | | 7/1962 | Inman | |
| 3,226,590 A | | 12/1965 | Christy | |
| 3,504,215 A | | 3/1970 | Evans | |
| 5,220,249 A | | 6/1993 | Tsukada | |
| 5,479,069 A | | 12/1995 | Winsor | |
| 5,858,046 A | | 1/1999 | Allen et al. | |
| 6,118,215 A | * | 9/2000 | Byrum et al. | 313/634 |

* cited by examiner

*Primary Examiner*—Ashok Patel
(74) *Attorney, Agent, or Firm*—Milton M. Peterson; Timothy M. Schaeberle

(57) ABSTRACT

A light emitting device comprising a glass envelope having front and back members, at least one of the members having a continuous channel (22) formed in one surface, the channel including connected sections (24 and 26) having different dimensions, the members being hermetically joined to enclose the channel.

15 Claims, 4 Drawing Sheets

GLASS ENVELOPE HAVING CONTINUOUS INTERNAL CHANNEL WITH CONNECTED SECTIONS OF DIFFERENT DIMENSIONS

This application claims the benefit of U.S. provisional application No. 60/042,568, filed Apr. 1, 1997.

FIELD OF THE INVENTION

Glass envelope for a light emitting device and its production, particularly an envelope for a neon discharge lamp that has an internal channel.

BACKGROUND OF THE INVENTION

Light emitting devices having an envelope with an enclosed, internal channel have been disclosed. Such envelopes are commonly formed from glass, are evacuated, and are backfilled with an ionizable gas. The envelope may be formed by laminating two glass sheets, or plates, at least one sheet or plate having an enclosed channel formed in a surface. The sheets may be hermetically sealed, for example, with a sealing glass frit.

It has been common practice to form an internally channeled, laminated sheet envelope by cutting channels in a bottom glass plate. The channels may be formed by grinding, etching, sandblasting, or otherwise hollowing out a desired pattern in the plate. The top plate is then sealed, as with a sealing paste, to the bottom plate to form an enclosed channel.

This procedure is too expensive and time consuming to be practical for any but special applications. Also, the weight of the finished product ralitates against such uses as automotive lights where weight is most significant. This situation has led to a search for a more practical method of producing an internally channeled, lamp envelope.

Commonly assigned, copending application Ser. No. 08/634,485 (Allen et al.) discloses such a process and the glass envelope thereby produced. The teachings of that application are incorporated herein in their entirety. The method disclosed in the application comprises successively delivering two sheets from a source of glass. A first glass sheet is delivered to a mold assembly having the desired channel forming pattern and a peripheral surface which the glass sheet overlies. The glass sheet may be caused to conform to the mold by the force of gravity, by drawing a vacuum, or by a combination of forces. The second sheet is then delivered over the conformed, bottom sheet at a viscosity such that it hermetically seals to the raised portion of the bottom sheet, but does not sag into the channels of the mold. This provides an enclosed, internally channeled, lightweight envelope in an efficient manner.

The present invention represents an improvement in the lamp envelope just described and its method of production. A lamp with the improved envelope can more efficiently focus light onto a desired target area. This means that less light need be generated with the result that input power can be reduced. Also, lamp life is known to be shortened by increased current. Thus, by reducing input power, and consequently current, lamp life can be extended significantly. Finally, the new envelope provides more design options for gas discharge lamps, particularly automotive lamps such as tail lamps.

SUMMARY OF THE INVENTION

Broadly, the invention resides in a glass envelope for a light emitting device comprising front and back members, at least one member having a continuous channel formed in one surface, the channel including connected sections alternating in dimensions, the members being hermetically joined to enclose the channel.

The invention further resides in a light emitting device comprising a glass envelope as just described wherein the envelope contains an ionizable gas and means to generate a discharge in that gas.

The invention also embodies a method of producing an envelope for a light emitting device comprising:

(a) delivering a first sheet of molten glass and depositing it on the surface of a mold having a contour including a continuous channel formed in the surface within a peripheral portion of the surface, and having alternating, connected sections of different dimensions, (b) forming a continuous channel in the first sheet of glass corresponding to the channel in the mold by substantially conforming the sheet of glass to the contour of the mold, and (c) delivering a second sheet of glass and depositing this second sheet over the channel in the first sheet and in contact with the peripheral portion of that first sheet, (d) depositing the second sheet while it is at a temperature sufficient to hermetically unite with the peripheral portion of the first sheet, but insufficient to sag into the channel of the first sheet, thereby forming a hermetically sealed, glass envelope having an internal channel having connected sections of different dimensions.

PRIOR ART

Prior patents of potential interest known to Applicant are listed and described in a separate document.

DESCRIPTION OF THE INVENTION

Figure 1:
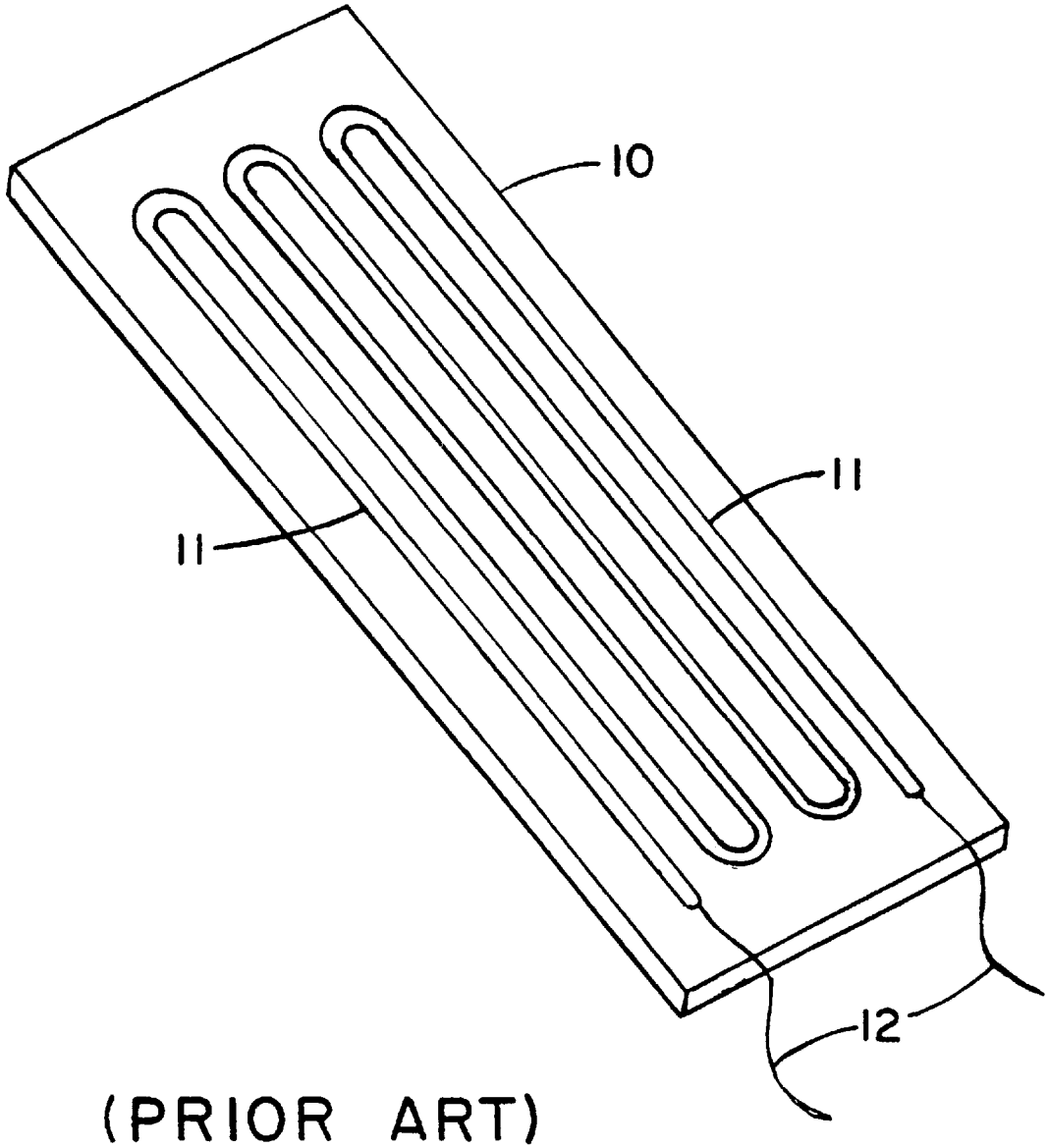
(PRIOR ART) Fig. 1
FIG. 1 is a perspective view of a multi-channeled glass envelope as disclosed in the copending Allen et al. application.

FIG. 1 is a perspective view of the multi-channeled, glass envelope 10 shown in FIG. 1 of the copending Allen et al. application noted earlier. Article 10 is shown with a continuous, internal, or enclosed, channel 11 molded in a serpentine array 12. Such a serpentine array is employed for most purposes. However, article 10 may have a single, straight channel if desired.

The internal channel 11, disclosed in the Allen et al. application, has uniform dimensions, that is, uniform width, depth, and cross-section throughout. The present invention adopts the internal channel principle, but modifies that principle to more efficiently focus light onto a desired target area. The present inventive modification converts the continuous channel having uniform dimensions to a continuous channel having connected, alternating sections of different dimensions.

Figure 2:
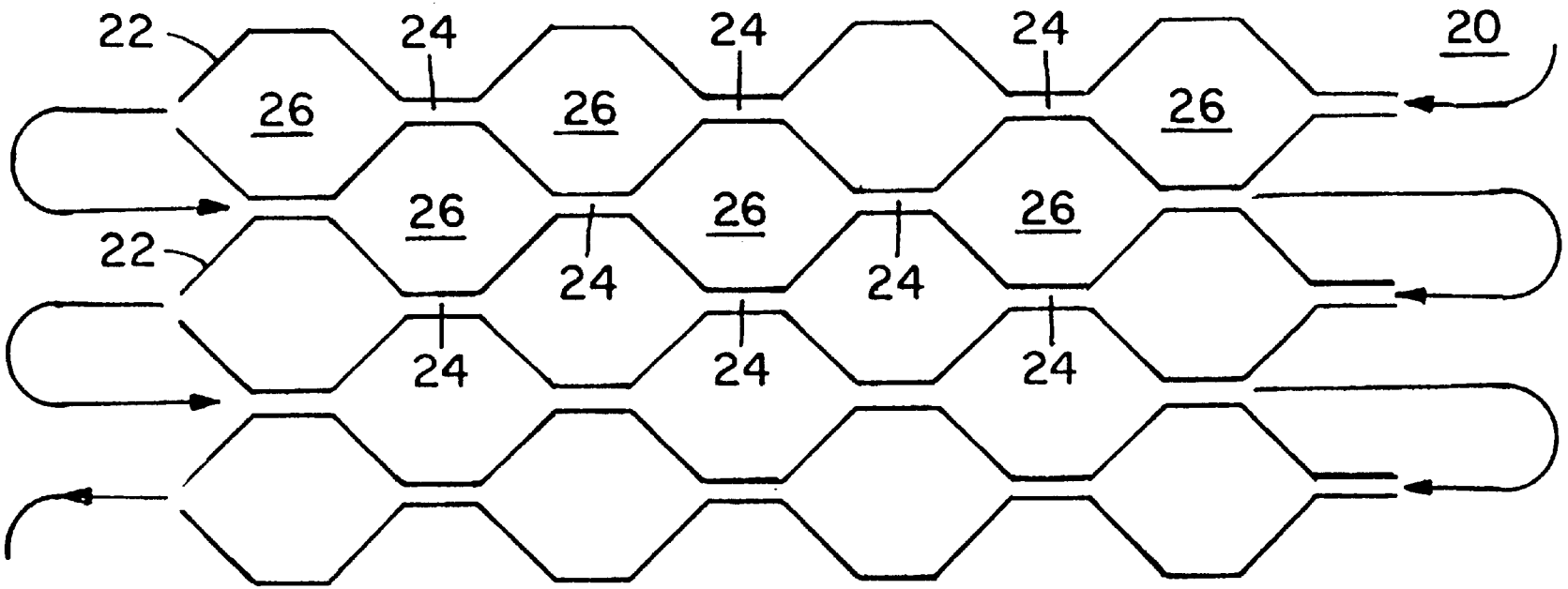
FIG. 2 is a schematic top view of a portion of a glass envelope produced in accordance with the present invention.

FIG. 2 is a schematic top view of channel lengths 22 in a serpentine channel array 20. Channel lengths 22 form a nested array of narrow channel sections 24 and wide channel sections 26 that illustrate the principle of the present invention.

Conventional optical means allows light from a continuous, uniform channel to be focused largely in one direction only. For example, a linear, optical element in front of an active channel can gather light and focus it into a band of light parallel to the original channel. However, light in the plane of the channel emanates at all angles and much of it will not be directed at a target. This is simply the result of focusing a line of light versus focusing a point of light.

The photometric requirements for an automotive tail light are quite specific. The light must be directed within a rectangle +/−20 degrees to the vertical plane and +/−10 degrees to the horizontal plane. Light outside of this rectangle does not contribute to meet photometric requirements.

It is also known that a reservoir is useful to maintain gas pressure for a neon discharge as neon atoms are depleted from the volume by sputtering. At low operating pressures of, for example, 5–10 Torr, where luminous efficiency is greatest, the presence of a reservoir becomes critical to the design of a viable product. Low pressure also enhances lumens/watt. Therefore, the ratio of reservoir volume to active channel volume is a critical parameter.

A light emitting device having an internal channel, as illustrated by array 20 in FIG. 2, emits light most intensely at the narrow sections 24. In the larger bulbous sections 26, the discharge will be diffused, and the light emitted will be much less intense.

The light emitted at narrow sections 24, which can have a calculated small size, can be focused much as if the light were emanating from a point source. Then the use of axisymmetric optics can be employed to direct much of the available light to an appropriate area. This is in contrast to a device with a channel of uniform size.

Larger sections 26 will not contribute any significant amount of light. They will act as reservoir volume to supply gas to the narrow areas 24 as needed. The voltage drop across sections 26 will be less than across an equivalent length 24 so that power requirements will be less.

In the present system, total light output is a collection of blended points of light. The degree of blending is determined by details of the lens optics, and by the spacing in the array. In principle, any size lamp can be made with a given appearance. The arrangement of large and small sections 24 and 26, can be a repetitive pattern that can be extended over a large area if desired.

Figure 3:
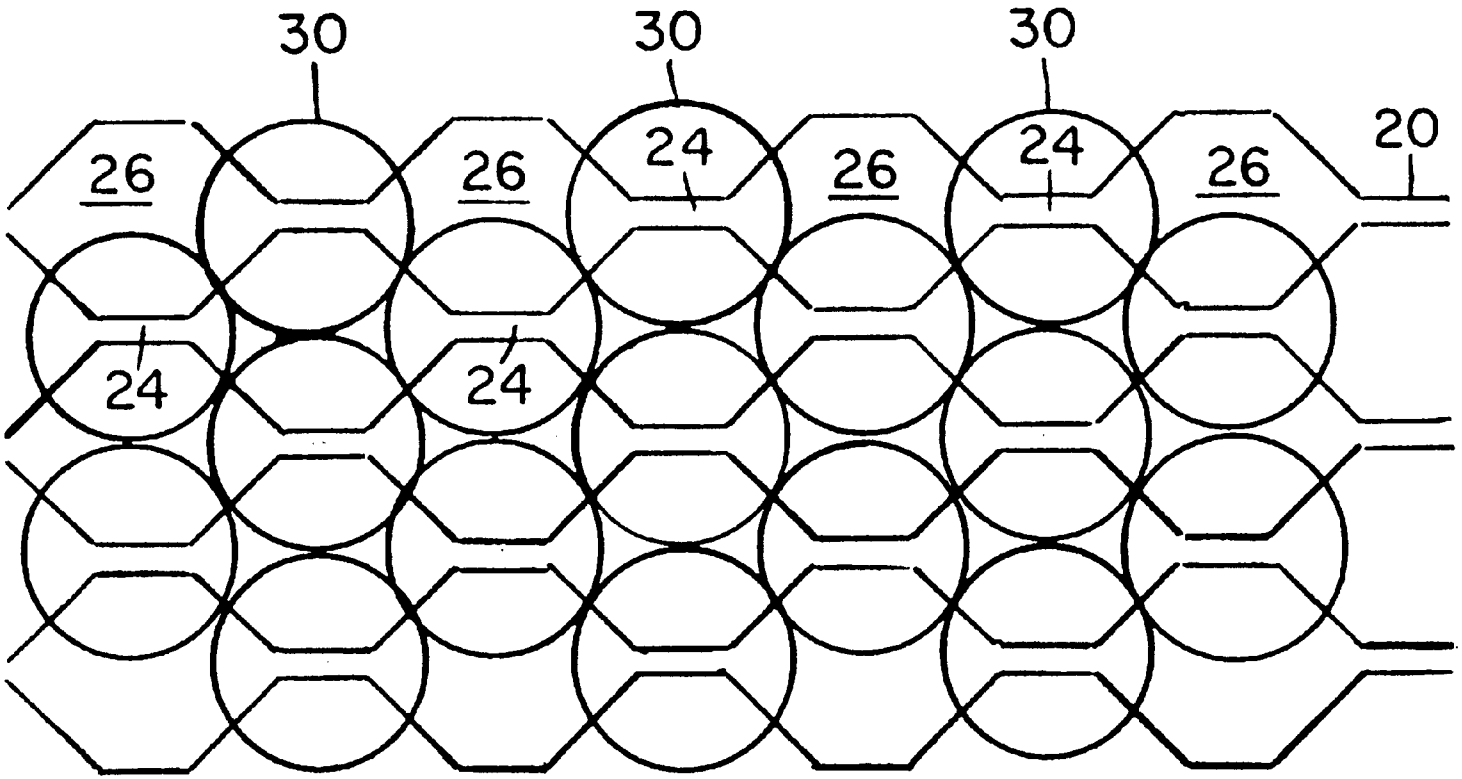
FIG. 3 corresponds to FIG. 2 with circular lenses added to focus light from the article.

FIG. 3 is a schematic top view of a serpentine array corresponding to that shown in FIG. 2. In FIG. 3, a circular lens 30 is positioned with respect to each narrow section 24 in channel 20. Lens 30 may be either plano-convex or Fresnel. It serves to collimate light from high intensity sections 24. While shown as circular, lenses 30 may take other forms, such as nested hexagons.

The present invention is particularly useful in production of a small lamp, such as a 10 mm (4 inch) diameter truck rear light. In such a lamp, the SAE photometric requirements require the light to be directed within a rectangle as previously described for a taillight.

Figure 4:
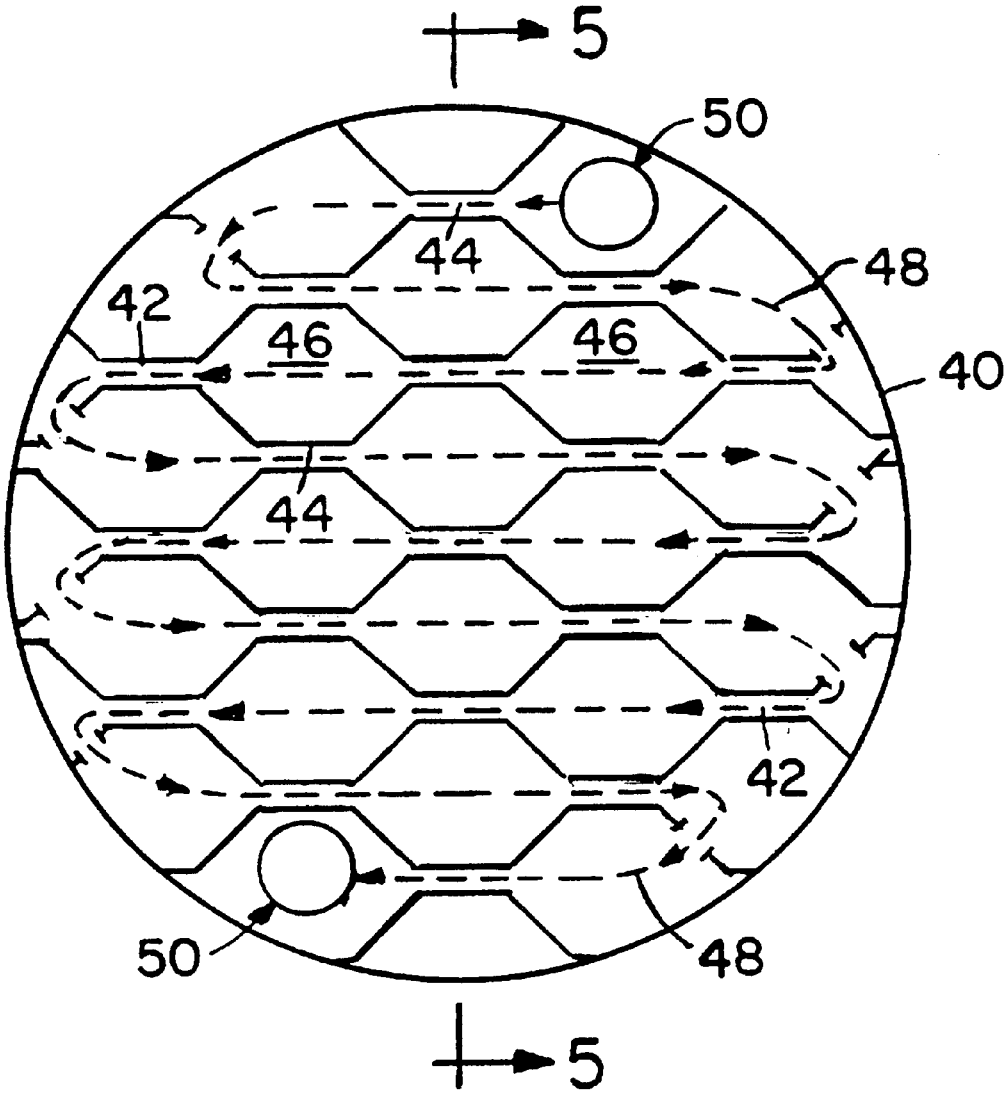
FIG. 4 is a top plan view of a glass envelope in accordance with the present invention.

FIG. 4 is a top plan view of a glass envelope 40 for the lamp just described. Channel 42 comprises small sections 44 and large sections 46. A dotted line and arrows 48 trace the discharge path between electrode sites 50.

Figure 5:
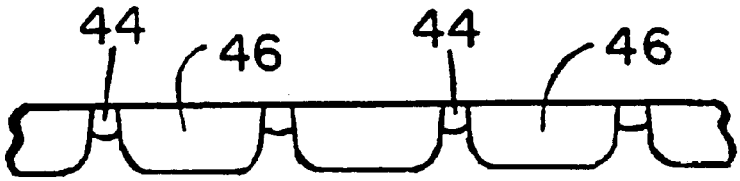
FIG. 5 is a cross-sectional view taken along line 5—5 in FIG. 4.

FIG. 5 is a cross-sectional view taken along line 5—5 in FIG. 4.

Light intensity measurements were made using different channel lengths selected from a total channel having a design deemed suitable for a viable lamp. An operating voltage and current were imposed between the electrodes with the channel containing neon gas at a pressure of about 7 Torr.

The length of active channel was varied from 6.4 to 31.8 mm (0.25 to 1.25 inches) in 6.4 mm (0.25 inches) increments and the light was focused on the target area using a 31.8 mm (1.25 inches) diameter Fresnel lens with a nominal focal length of 12.7 mm (0.5 inches). The centerpoint of the target area, that is, the point where the horizontal and vertical center lines intersect, is commonly known as the horizontal-vertical (H-V) point. At this position, the light intensity measured 1.9 lux with no lensing and the full 31.8 mm (1.25 inches) length emitting light. A cylindrical lens was able to increase this value to 6.05 lux, typical of the performance at the centerpoint for a cylindrical lens. The circular Fresnel lens increased the intensity anywhere from 8.35 lux for a 6.4 mm (0.25 inches) aperture length to 8.85 lux with the full 31.8 mm (1.25 inches) aperture. The longer aperture, although not having a great impact at the centerpoint did enhance intensity at most of the other points. These results are summarized in Table I.

From this test, one is able to conclude that more of the available light can be directed at the SAE target area for stop and tail lights using circular optics rather than linear optics. Linear optics allow too much light to be lost to the sides of the SAE target.

TABLE I

| Exposed Channel Length (in mm) | Lux (no lens) | (circular) Lux (Fresnel) | Lux (cylindrical) |
|---|---|---|---|
| 31.8 | 1.9 | 8.85 | 6.05 |
| 25.4 | 1.35 | 8.65 | NA |
| 19.1 | 1.10 | 8.65 | NA |
| 12.7 | 0.70 | 8.65 | NA |
| 6.4 | 0.35 | 8.35 | NA |

We claim:

1. A glass envelope for a light emitting device comprising front and back members, at least one of the members having a continuous channel formed in one surface, the channel including connected sections having different dimensions, the members being hermetically joined to enclose the channel.

2. A glass envelope in accordance with claim 1 wherein the front and back members are glass sheets.

3. A glass envelope in accordance with claim 1 wherein a member having a continuous channel formed therein has a peripheral portion surrounding the channel that is sealed to the other member.

4. A glass envelope in accordance with claim 1 wherein the continuous channel is a serpentine array of channel lengths.

5. A glass envelope in accordance with claim 1 wherein the continuous channel has sections of alternating size, one section being substantially smaller than the other.

6. A light emitting device comprising a glass envelope having front and back members, at least one of the members having a continuous channel formed in one surface, the channel including connected sections having different dimensions, the members being hermetically joined to enclose the channel.

7. A light emitting device in accordance with claim 6 wherein the front and back members of the glass envelope are glass sheets.

8. A light emitting device in accordance with claim 6 wherein a member of the glass envelope having a continuous channel formed therein has a peripheral portion surrounding the channel that is sealed to the other member.

9. A light emitting device in accordance with claim 6 wherein the continuous channel in the glass envelope member is a serpentine array of channel lengths.

10. A light emitting device in accordance with claim 6 wherein the continuous channel in the glass envelope has sections of alternating size, one section being substantially smaller than the other.

11. A light emitting device in accordance with claim 10 wherein the continuous channel contains an ionizable gas and means to create a discharge through the gas.

12. A light emitting device in accordance with claim 11 wherein light is emitted primarily from the smaller sections of the channel and the larger sections serve essentially as a gas reservoir.

13. A light emitting device in accordance with claim 12 wherein a light focusing lens is associated with and receives light from each small section in the continuous channel.

14. A light emitting device in accordance with claim 13 wherein each associated lens is a plano-convex lens.

15. A light emitting device in accordance with claim 13 wherein each associated lens is a Fresnel lens.

* * * * *